US006375314B1

(12) United States Patent
Reed et al.

(10) Patent No.: US 6,375,314 B1
(45) Date of Patent: Apr. 23, 2002

(54) REMOVABLE CASSETTE HAVING INTEGRATED SUPPLY OF CONSUMABLES

(75) Inventors: William H. Reed; John D. Zbrozek, both of Lexington, KY (US)

(73) Assignee: Lexmark International Inc., Lexington, KY (US)

( * ) Notice: Subject to any disclaimer, the term of this patent is extended or adjusted under 35 U.S.C. 154(b) by 0 days.

(21) Appl. No.: 09/633,158

(22) Filed: Aug. 4, 2000

(51) Int. Cl.[7] ..... B41J 2/175; B41J 32/00
(52) U.S. Cl. ..... 347/85; 347/214
(58) Field of Search ..... 347/85, 86, 87, 347/104, 108, 214, 215; 399/110, 111

(56) References Cited

U.S. PATENT DOCUMENTS

| | | | | |
|---|---|---|---|---|
| 3,967,292 A | | 6/1976 | Delahunt | 354/174 |
| 4,264,169 A | | 4/1981 | Harvey | 354/121 |
| 4,432,005 A | | 2/1984 | Duffield et al. | 347/85 |
| 4,607,261 A | | 8/1986 | McCann et al. | 346/75 |
| 4,771,313 A | | 9/1988 | Kuroda et al. | 355/3 R |
| 4,803,502 A | | 2/1989 | Hashimoto et al. | 347/215 |
| 4,806,960 A | | 2/1989 | Momot et al. | 354/21 |
| 5,017,962 A | | 5/1991 | Tsuji et al. | 355/210 |
| 5,034,760 A | | 7/1991 | Khait | 354/105 |
| 5,146,270 A | | 9/1992 | Matsuo et al. | 355/200 |
| 5,243,360 A | | 9/1993 | Tomoda et al. | 347/214 |
| 5,249,873 A | | 10/1993 | Okunomiya et al. | 400/120 |
| 5,410,641 A | | 4/1995 | Wakabayashi et al. | 395/112 |
| 5,451,996 A | | 9/1995 | Awai et al. | 347/214 |
| 5,500,669 A | * | 3/1996 | Yamashita et al. | 347/214 |
| 5,621,450 A | | 4/1997 | Kawai et al. | 347/108 |
| 5,623,328 A | | 4/1997 | Tsuda et al. | 399/111 |
| 5,682,191 A | * | 10/1997 | Barrett et al. | 347/104 |
| 5,706,104 A | | 1/1998 | Sugiura et al. | 358/444 |
| 5,748,216 A | | 5/1998 | Scheffelin et al. | 347/86 |
| 5,778,284 A | | 7/1998 | Kumar et al. | 399/111 |
| 5,784,671 A | | 7/1998 | Damji et al. | 399/110 |
| 5,809,376 A | | 9/1998 | Chiesa et al. | 399/111 |
| 5,839,028 A | | 11/1998 | Nomura et al. | 399/103 |
| 5,898,450 A | | 4/1999 | Ahn | 347/87 |
| 6,069,642 A | * | 5/2000 | Isobe | 347/214 |
| 6,082,854 A | * | 7/2000 | Axtell et al. | 347/108 |
| 6,149,256 A | * | 11/2000 | McIntyre et al. | 347/2 |

FOREIGN PATENT DOCUMENTS

| | | | | |
|---|---|---|---|---|
| JP | 359190857 | * | 10/1984 | 347/86 |
| JP | 411254700 A | * | 9/1999 | B41J/2/175 |

* cited by examiner

*Primary Examiner*—Anh T. N. Vo
(74) *Attorney, Agent, or Firm*—Dinsmore & Shohl LLP

(57) ABSTRACT

A removable cassette for a photoprinter includes a reservoir containing a consumable source of ink adapted to be used by the photoprinter for printing, and a consumable supply of printable media sheets adapted to be printed upon by the photoprinter using the source of ink. The consumable source of ink for use with the photoprinter, and the printable media sheets for use with the photoprinter in conjunction with the consumable source of ink, wherein the consumable source of ink and the printable media sheets are integrated into the cassette removable from the photoprinter.

13 Claims, 2 Drawing Sheets

REMOVABLE CASSETTE HAVING INTEGRATED SUPPLY OF CONSUMABLES

FIELD OF THE INVENTION

The present invention relates to removable cassettes having an integrated supply of consumables, for example ink and paper, for printer apparatus, and to printers including such cassettes.

BACKGROUND OF THE INVENTION

The advent of computers has fundamentally changed the way images can be stored, manipulated and printed. Images can now be captured by digital devices, such as digital cameras and scanners, and stored digitally. A digitally stored image can be transmitted, enhanced, and/or otherwise manipulated through computer programs. Moreover, as digital technology has improved and associated costs have fallen, the resolution of the images captured by these devices continues to improve, and in many cases approaches or exceeds the quality of traditional film photography.

Traditionally, to use a digital image one needed a computer. The computer would be loaded with a variety of different programs to transmit, enhance and manipulate the digital images. To obtain a hard copy of the digital image, the user would direct the computer with an appropriate series of commands to send a "print job" from the computer to a traditional printer. While the traditional model works, it does have attendant shortcomings, such as being expensive, complicated, non-portable, and the like. To combat such shortcomings, various manufacturers began offering stand-alone printers designed to print digital images. One example of a stand-alone printer is disclosed in U.S. patent application Ser. No. 09/164,500, filed on Oct. 1, 1998. While stand-alone printers have provided remarkable benefits over the traditional model, the present invention offers even more benefits and improvements for stand-alone printers.

SUMMARY OF THE INVENTION

Accordingly, an object of the invention is to facilitate use of a printer. It is another object to provide a removable cassette for use with a printer, wherein the cassette includes an integrated supply of consumables such as ink and paper for printers.

In one embodiment, the invention is directed to a printer comprising a) a source of ink for use with the printer, and b) printable media for use with the printer in conjunction with the source of ink, wherein the source of ink and printable media are integrated into a cassette which is removable from the printer. In another embodiment, the invention is directed to a removable cassette for a printer wherein the cassette comprises a) a reservoir containing a consumable source of ink adapted to be used by a printer for printing, and b) a consumable supply of printable media adapted to be printed upon by a printer using the source of ink. In yet another embodiment, the invention is directed to a removable cassette for a photoprinter, wherein the cassette comprises a) a supply of printable media, and b) a reservoir of ink usable by a photoprinter to print digital images onto the printable media.

Still other objects, aspects and advantages of the present invention will become apparent to those skilled in the art from the following detailed description, which is by way of illustration only. As will be appreciated, the invention is capable of other different and obvious aspects, all without departing from the invention. Accordingly, the drawings and descriptions are illustrative in nature and not restrictive.

BRIEF DESCRIPTION OF THE DRAWINGS

The following detailed description will be more fully understood in view of the accompanying drawings which illustrate several aspects of the present invention. In the drawings.

DETAILED DESCRIPTION

Figure 1:
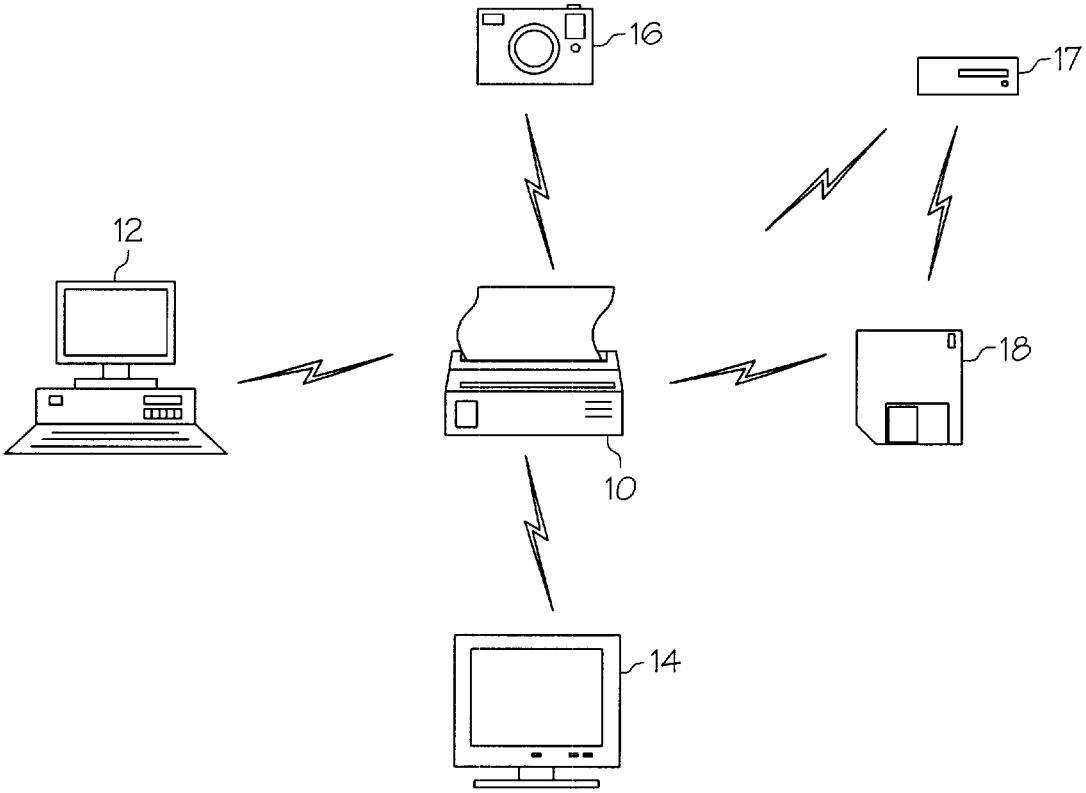
FIG. 1 depicts a photoprinter communicating with a variety of external components.

Reference will now be made to various embodiments of the invention, an example of which is illustrated in the accompanying drawings, wherein like numerals indicate the same element throughout the views. FIG. 1 illustrates one embodiment of a printer according to the present invention, for example a photoprinter 10. As used herein, a "photoprinter" refers to a stand-alone appliance for printing digital photographs onto a printable medium. A "digital photograph" is a photographic image captured by a light sensing electronic device (e.g., CCD, CMOS, CID, or the like) and converted into a digital file capable of being stored on a computer readable medium. The term "stand-alone" means that the printer is capable of processing and printing digital files independent of an external host device, such as a computer, wherein "processing" means calculating a pixel pattern to be printed on the printable medium that represents the corresponding digital file (sometimes referred to as "ripping" or generating printing code). For instance, a printer is considered stand-alone if an external device merely passes a digital photograph to the printer and the printer contains the logic for processing and printing the digital photograph. The foregoing definitions are inclusive and open-ended. For example, a stand-alone printer may additionally be capable of receiving printing code from an external device. As a further example, a photoprinter may additionally be capable of processing and printing digital files other than digital photographs, such as text files, word processing files, HTML files, and the like.

The photoprinter 10 is operative to print digital photographs on printable media (e.g., paper, glossy film or photo paper, index cards, labels, envelopes, transparencies, coated paper, cloth, etc.). In one embodiment, the photoprinter 10 works by transferring an ink (e.g., toner, dye, pigment, wax, carbon, etc.) onto a printable medium. For instance, the photoprinter 10 can employ conventional thermal ink jet technology, although the present invention can employ other types of ink jet technologies, such as piezo ink jet. In addition, the present invention can be adapted for use with other printer technologies, such as electrophotography, dye diffusion, thermal transfer, and the like.

While the photoprinter 10 operates as a stand-alone printer, it can nevertheless communicate with a variety of external components, only a portion of which are illustrated in FIG. 1. In the present example, the photoprinter 10 can communicate to a computer 12 using any one of a variety of different communication links, such as parallel cables, serial cables, telephone lines, universal serial bus port "USB", firewire, bluetooth, fiber optics, infrared "IR", radio frequency "RF", network interface cards (e.g., Ethernet, token ring, etc.), and the like. The computer 12 can be any conventional or special purpose computer, such as a desktop computer, a tower computer, a micro-computer, a minicomputer, server, workstation, palmtop computer, notebook computer, or the like. Through the communication link, the photoprinter 10 can receive digital photographs from the computer 12 for processing and printing. In one embodiment, the computer 12 is programmed to generate printing code (e.g., via locally loaded print drivers) and the photoprinter 10 is capable of receiving the externally processed printing code for direct printing. As such, the photoprinter 10 would have dual functionality: a stand-alone printer as well as a more conventional printer for receiving commands from an external device.

In the present example, the photoprinter 10 can also communicate with an external display 14 (e.g., a television, monitor, LCD, or the like) using an appropriate communication link. In such a configuration, the photoprinter 10 can generate and send appropriate signals to present a user interface to operate the photoprinter 10 or preview digital photographs on the display 14. The photoprinter 10 also can communicate with a digital camera 16 using an appropriate communication link. Typically, a digital camera 16 includes one or more lenses that focus light into an image on a light sensing electronic device, and stores the image as a digital photographic image. In one embodiment, the photoprinter 10 can retrieve, process and print digital photographic images stored in the camera 16.

The photoprinter 10 can also communicate with a computer readable medium 18, shown here as a floppy diskette. A computer readable medium stores information readable by a computer, such as programs, data files, etc. As one with ordinary skill in the art will readily appreciate, a computer readable medium can take a variety of forms, including magnetic storage (such as hard drives, floppy diskettes, tape, etc.), optical storage (such as laser disks, compact disks, digital video disks ("DVD"), etc.), electronic storage (such as random access memory ("RAM"), read only memory ("ROM"), programmable read only memory ("PROM"), flash memory, memory sticks, etc.), and the like. Some types of computer readable media, which are sometimes described as being non-volatile, can retain data in the absence of power so that the information is available when power is restored.

The photoprinter 10 preferably interfaces with the computer readable medium 18 using an internal drive (not shown) or an external drive 17. As used herein, the term "drive" is intended to mean a structure which is capable of interfacing with (e.g., reading from and/or writing to) a computer readable medium. Naturally, suitable drives will vary depending upon the specific computer readable medium 18 being employed. In a preferred embodiment, the photoprinter includes first and second drives each adapted to receive a solid state flash memory card. The first and second drives are preferably both internal drives. Flash memory cards, due to their very small size and lightweight, are a highly portable computer readable medium which are electronically re-writable and are non-volatile More preferably, the first and second drives are adapted to receive different types of flash memory cards, such as NAND type of flash memory card (e.g., a SMART MEDIA card developed by Toshiba, Inc.) or a PCMCIA type of flash memory card (e.g., the COMPACTFLASH developed by SanDisk, Inc.)

Figure 2:
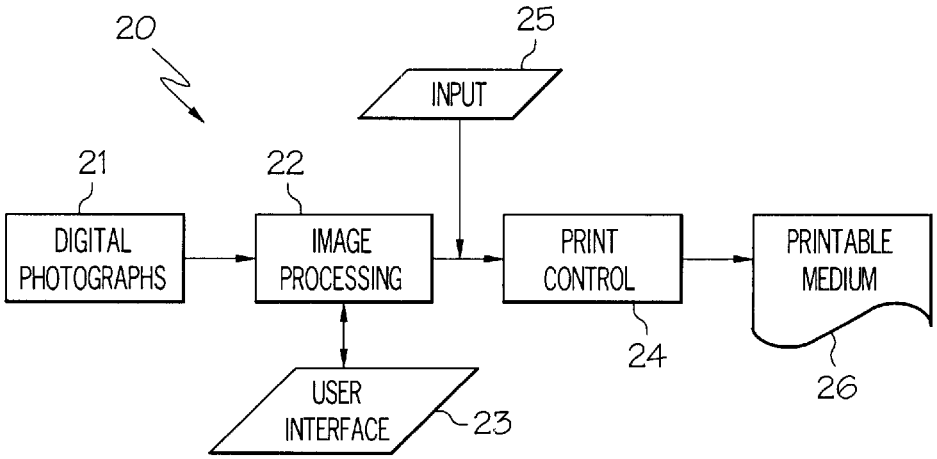
FIG. 2 depicts an operational block diagram for the photoprinter of FIG. 1.

FIG. 2 depicts a preferred operational block diagram 20 for the photoprinter 10. One or more digital photographs 21 are input to the image processing block 22, located internal to the photoprinter 10. The digital photographs 21 can be received from a variety of different sources, whether internal to the photoprinter 10 or from an external source via a drive, communications link, or the like. Furthermore, the digital photographs 21 can take any one of a variety of different file formats, whether raster, vector, or other format (e.g., GIF, TIFF, PCX, JPEG, EXIF, CIFF, JFIF, etc.).

The image processing block 22 is responsible for calculating a pixel pattern to be printed on the printable medium 26 that represents the corresponding digital photographs 21, sometimes referred to in the art as generating printing code. The image processing block 22 may optionally enhance the digital photographs 21. For instance, photo enhancement software, such as the PICTURE IQ software by Digital Intelligence, may be incorporated into the image processing 22. Further, image processing 22 may optionally include a variety of different resources to modify the printed rendition of the digital photographs 21, such as the addition of text, frames, templates, scaling, etc. Enhancements or resources may be implemented before and/or after the digital photographs 21 are converted to printing code. A user interface 23 is provided to allow a user to interact with and/or direct the image processing block 22 (e.g., controlling the enhancements and/or resources). The user interface 23 may be integral with the photoprinter 10 or located on an external component. Preferably, however, the photoprinter 10 includes an LCD display with one or more buttons or other input devices. Optionally, the user interface 23 may take the form of a series of instructions accompanying the digital photographs 21, such as a digital print order format.

The print code generated during image processing 22 is passed to the print control 24. When printing code is generated from an external source (e.g., the computer 12), the printing code can be provided as input 25 directly to the print control 24, thus bypassing the image processing block 22. The print control 24 is responsible for directing the physical transference of the pixel pattern represented by the printing code to the printable medium 26. The photoprinter 10 is preferably in the form of a thermal ink jet printer having one or more conventional thermal ink jet print heads. During printing, the print control 24 directs one or more motors to move the printable medium 26 relative to the photoprinter 10 so that it is properly positioned for deposition of an ink pattern or swath. Once the printable medium 26 is in position, the print control 24 directs the print head to move along a conventional print head carriage in a direction transverse to the longitudinal direction while firing droplets of ink onto the surface of the printable medium 26. The print head may make one or more of these transverse passes to complete printing for the swath. After the swath is complete, the position of the printable medium 26 is adjusted longitudinally for the printing of the next swath.

Figure 3:
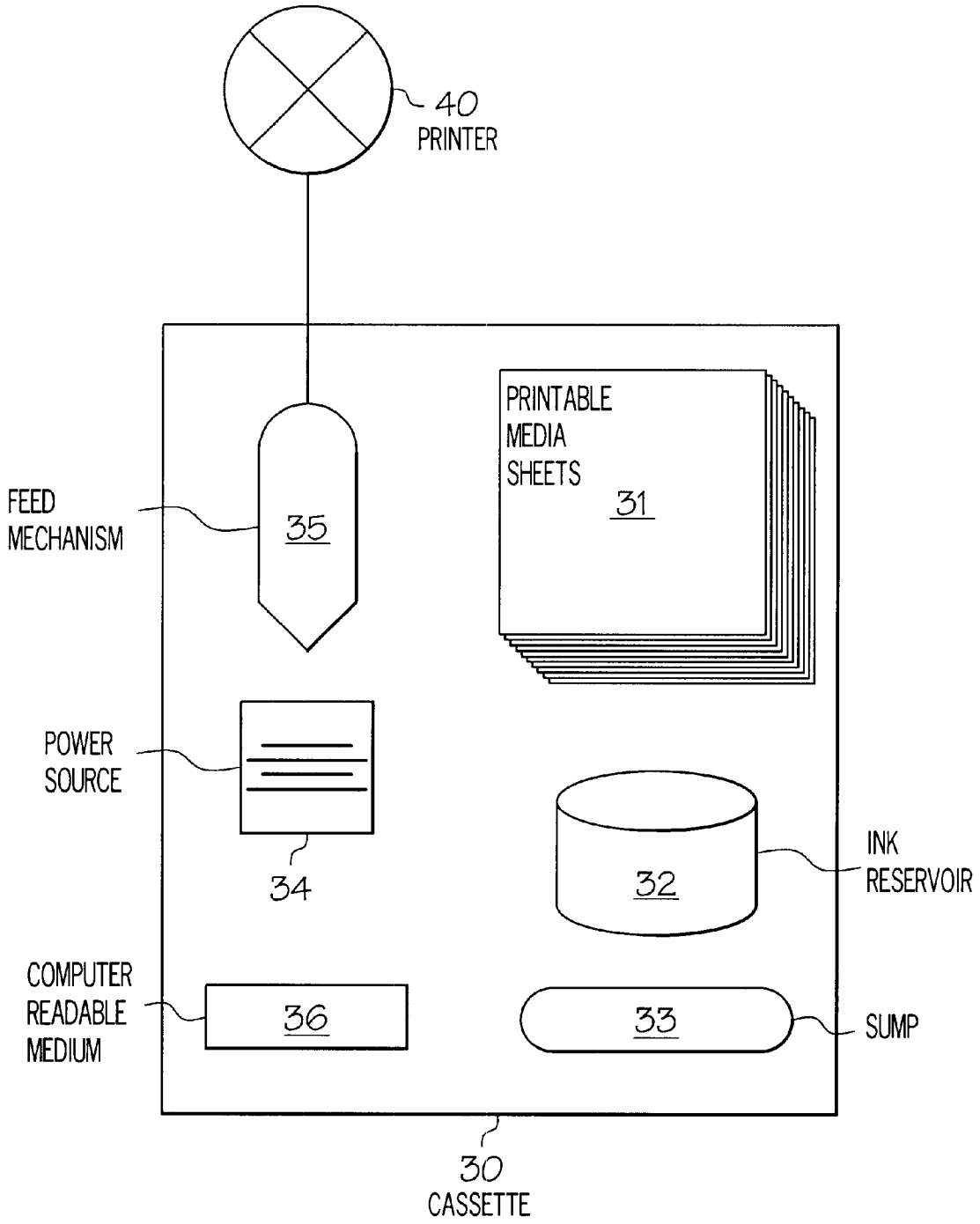
FIG. 3 depicts a removable cassette having an integrated supply of consumables for a printer.

FIG. 3 depicts one example of a removable cassette having an integrated supply for a printer. "Integrated" means that a plurality of items are brought together and united into a single component. In the present example, various supplies are integrated in a removable cassette 30 for a photoprinter. When an item is qualified with "removable," that term is intended to invoke that the item is intended to be removed and/or replaced in the ordinary course of usage. The cassette 30 is a modular unit designed to be inserted into a printer. In one embodiment, the various components in the cassette 30 are enclosed within a housing. For instance, the housing can be formed from a plastic material and contain appropriate geometry to physically couple to a printer, such as by being inserted in an external port of the printer, fitting internal to the printer, or the like.

Traditionally, supplies for printers designed to print photos are not optimized for customer convenience and reliability. Printers are generally designed to accept a range of paper types, weights, and sizes. Printing on plain copy paper is the primary requirement, and the paper supply is typically a loose stack in a tray. The ink, toner, or thermal transfer sheet may be typically packaged for convenience of replacement but often there is no indication when replacement is required. Replacement may be messy. Further, papers have been developed specifically for printing of photos on ink jet printers. These "photo papers" have the weight, stiffness, and gloss expected by customers for photographs. Some of these papers have surface coatings that are optimized for quick drying by absorption of the water in ink jet inks, while some have additives in the coating that fix the dyes onto the paper to improve print quality and/or color fade resistance. Most print technologies require an unprinted margin around the printed area, but some photo papers are perforated so that after an image is printed the selvage can be removed leaving a borderless print.

In the present invention, at least one of the components integrated in the cassette 30 is "consumable," which is intended to invoke that the component has a limited supply. For instance, the cassette 30 contains a consumable supply 31 of printable media (e.g. photo paper) and a consumable reservoir 32 of ink. Preferably, the ink reservoir 32 in the cassette 30 provides sufficient ink to print photos on all of the printable media supply 31 in the cassette 30, so there is no concern about running out of ink in the middle of a page or during a long print job. In a further preferred embodiment, the amount of ink in reservoir 32 is not in substantial excess of that required to print photos on all of the printable media supply 31, so that the cassette 30 can be removed from the printer and, if desired, discarded once the printable media supply 31 is exhausted, without waste of excess ink.

The removable cassette can be provided with a selected amount of printable media, and preferably contains an appropriate amount of ink for that number of sheets. In one implementation, the cassette 30 also contains a sump 33 for waste ink generated during priming when the cassette 30 is installed or during printhead maintenance. The ink in the reservoir 32 is preferably matched to the printable media 31. In this way, improvements in print quality and performance can be introduced with appropriate combinations of ink and media within the same cassette. In the same manner, multiple supply items with different combination sets of ink and media may be offered, thereby providing a choice of results, such as differences in paper weight or surface finish, variation in water or fade resistance, choices of color sets, and the like.

Optionally, the cassette 30 contains at least one feed mechanism 35 that engages with one or more corresponding parts 40 in the printer to effect, assist or initiate feeding of the printable media from the cassette. For example, a motor in the printer might engage with gears and drive wheels in the cassette 30. Further, the feed mechanism 35 may be configured to match or identify a particular printable media supply 31 to the printer. In one preferred implementation, the printable media supply 31 is perforated photo paper having a selvage around the printed area. The selvage includes one or more register elements (for example, notches, holes, or printed marks) which are used by the feed mechanism 35 to drive the paper or to accurately locate the position of the paper, for example under an ink jet printhead. Accurate control of paper placement can improve print quality. For example, register elements on the photo paper selvage may be sensed to enable a closed loop of feedback to a motion controller for the paper and/or a printhead. General-purpose ink jet printers must have larger print gaps to accommodate envelopes and plain papers that buckle with moisture from jet printer inks. A smaller print gap improves print quality because it reduces deviation from the intended position for ink drops from misdirected jets. Additionally, improved print quality can be achieved in a photoprinter by taking advantage of the typically heavy weight and high beam strength of photograde paper. In a photoprinter designed to print exclusively on rigid papers, the gap between the paper and printhead can be reduced to a minimum so that print quality is improved.

In one embodiment, the cassette 30 may include a consumable power source 34, such as a fresh battery, to power the printer. Accordingly, the cassette 30 permits the printer to be more compact, portable, and dependable. The power source 34 preferably contains sufficient power to feed and print all printable media 31 in the cassette 30, thus reducing concern about running low on power in the middle of a print job.

Optionally, the cassette 30 includes a computer readable medium 36 containing data to be read by the printer, which can take a variety of different forms. For instance, the computer readable medium 36 can be a magnetic strip, smart chip, or other non-volatile storage that can be read by the photoprinter when the cassette 30 is inserted into the photoprinter. By incorporating data storage into the integrated supply, improved printing and products may be obtained. One example of the type of data which can be stored on the medium 36 is data defining a unique paper and ink combination in the integrated supply to optimize printing results. The data could adapt color tables and other printing parameters within the photoprinter to suit a particular paper/ink combination supplied in the cassette and identified by the data on medium 35. A further example of the type of data includes additional frames, fonts, or background art to be used in printing. For instance, frames with seasonal themes (representing holidays or special events, for example, graduation, birthday, etc.) might be provided. By combining such data with the integrated supply, their use could be limited to the life of the supply. Still another example of the type of data stored on the medium 35 includes new or special formats added to the operator panel menu (assuming this function is implemented in the printer). For instance, the paper in the supply might be preprinted with text or image, and the data in the integrated supply defines a unique page template designed to fit the preprinted paper.

The foregoing descriptions of the specific embodiments of the invention have been presented for purposes of illustration and description and are not intended to be exhaustive nor to limit the invention to the precise form disclosed. Many additional alternatives, modifications, and variations will be apparent to those skilled in the art in light of the above teaching. For instance, any combination of the various items discussed above can be integrated in a removable cassette for a printer or a photoprinter. Accordingly, this invention is intended to embrace all alternatives, modifications, and variations that fall within the spirit and broad scope of the amended claims.

We claim:

1. A photoprinter, comprising:

a) a computer readable medium upon which is encoded data readable by the photoprinter, b) a drive capable of interfacing with the computer readable medium, c) a reservoir containing a source of ink for use with the photoprinter; and d) a supply of printable media sheets for use with the photoprinter in conjunction with the reservoir containing the source of ink, wherein the computer readable medium, the reservoir containing the source of ink and the printable media sheets are integrated into a cassette which is removable from the photoprinter.

2. The photoprinter of claim 1, wherein the photoprinter is a stand alone photoprinter.

3. The photoprinter of claim 1, further comprising a power source for the photoprinter integrated into the cassette.

4. The photoprinter of claim 1, further comprising a feeding mechanism operative to initiate, effect or assist feeding the printable media sheets from the cassette.

5. The photoprinter of claim 4, wherein at least a portion of the feeding mechanism is integrated into the cassette.

6. A removable cassette comprising:

a computer readable medium upon which is encoded data readable by a printer comprising a drive capable of interfacing with the computer readable medium, a reservoir containing a consumable source of ink; and a consumable supply of printable media sheets, wherein the cassette is adapted to supply the printable media sheets and the source of ink to the printer.

7. The cassette of claim 6, further comprising at least one feeding mechanism operative to initiate, effect or assist feeding the printable media sheets from the cassette.

8. The cassette of claim 6, further comprising a power source for a printer.

9. The cassette of claim 6, further comprising a sump for waste ink.

10. The cassette of claim 6, further comprising a housing containing the reservoir and the printable media sheets.

11. A removable cassette comprising:

a) a computer readable medium upon which is encoded data readable by a photoprinter comprising a drive capable of interfacing with the computer readable medium, b) a consumable supply of printable media sheets; and c) a reservoir containing a consumable source of ink, wherein the cassette is adapted to supply the printable media sheets and the source of ink to the photoprinter to print digital photographs onto the printable media sheets.

12. The cassette of claim 11, further comprising a sump for waste ink.

13. The cassette of claim 11, further comprising a feeding mechanism operative to initiate, effect or assist feeding the printable media sheets from the cassette.

* * * * *